United States Patent [19]

Smith

[11] 4,303,507

[45] Dec. 1, 1981

[54] SCRAPER-SIFTER AND DISTRIBUTING DEVICE

[75] Inventor: Wedad J. Smith, El Paso, Tex.

[73] Assignee: Wrex-All Implements, Inc., Thibodaux, La.

[21] Appl. No.: 201,768

[22] Filed: Oct. 29, 1980

[51] Int. Cl.[3] ..... B07B 1/28

[52] U.S. Cl. ..... 209/252; 209/421; 37/117.5; 37/DIG. 12

[58] Field of Search ..... 209/235, 252, 260, 419, 209/420, 421; 37/117.5, DIG. 12, DIG. 3; 171/135, 136, 141; 172/272, 273, 247, 502; 414/724

[56] References Cited

U.S. PATENT DOCUMENTS

| | | | |
|---|---|---|---|
| 49,370 | 8/1965 | Buckland | 209/403 X |
| 637,342 | 11/1899 | Keller | 209/419 |
| 643,740 | 2/1900 | Cecil | 171/135 |
| 798,596 | 9/1905 | Callahan | 37/141 |
| 976,811 | 11/1910 | Kloss | 171/136 X |
| 1,316,058 | 9/1919 | Pugh | 37/141 X |
| 1,549,870 | 8/1925 | Hamlin | 171/135 X |
| 1,583,991 | 5/1926 | Orton | 171/136 X |
| 3,458,981 | 8/1969 | Banner | 177/136 X |
| 3,596,764 | 8/1971 | Smith | 204/421 |
| 4,172,687 | 10/1979 | Schultz | 414/724 |

FOREIGN PATENT DOCUMENTS

| | | | |
|---|---|---|---|
| 16944 | of 1891 | United Kingdom | 171/136 |

*Primary Examiner*—Ralph J. Hill

*Attorney, Agent, or Firm*—Wilkinson, Mawhinney & Theibault

[57] ABSTRACT

The present disclosure is directed to a ground-leveling and separating device for use with a front end loader having a loader bucket. The device has a blade backing trowel member having a pair of end walls and an upstanding rear wall defining an open ended box-like structure with a rod extending across the top of its open end. A pair of transversely spaced dividers having front to rear openings lie between the end walls and an attaching means has one end adapted to be connected to the rear of the front end loader bucket and the other end connected to the rear of said device, and an attaching means is connected proximate the forward end of the device at each of its ends and is adapted to be passed over said front bar at its other end and passing freely through the openings in said spaced dividers so that said ground-leveling and separating device could be selectively angularly oriented relative to said bucket and line of draft.

1 Claim, 5 Drawing Figures

SCRAPER-SIFTER AND DISTRIBUTING DEVICE

TECHNICAL FIELD

My invention relates to a scraper-sifter and distributing device which can be not only vertically varied but transversely oriented relative to its line of draft for distributing fine particles of earth while retaining larger stones and rocks within a scraper-sifter box-like structure for discharge separate from the particles of earth.

BACKGROUND ART

The best known art to the present invention known to me is my prior U.S. Pat. No. 3,596,764 and the prior art patents cited therein namely U.S. Pat. Nos. 49,370; 637,342; 643,740; 798,596; 976,811; 1,316,058; 3,458,981; and English Pat. No. 16.944 of 1891.

DISCLOSURE OF THE INVENTION

In accordance with my invention I provide a scraper-sifter distributor device which is connected for draft to the bucket of a front end loader and which may have its angle of draft varied relative to the front end loader bucket without having to change the front chain connections between the drafting front loader bucket and distributor device.

My improved device permits the draft angle of the distributor device to be varied relative to the front end bucket to which the draft chain is attached without changing the chain setting in the keyhole slot on the front top of the bucket or using plural chains. This is effected due to the passage of the single front draft chain over the front top bar, through the opening of one transverse separator thence through the opening of the other transverse separator, up over the top front bar to the keyhole slot at the other end of the front end bucket. By slackening the front chain with respect to the bucket the front wheels of the front end loader may be turned until the chain moves through the openings and the desired angular variance is attained between the bucket end and device then the front end loader is driven in the desired direction with the preset draft angle.

BEST MODE FOR CARRYING OUT THE INVENTION

Figure 1:
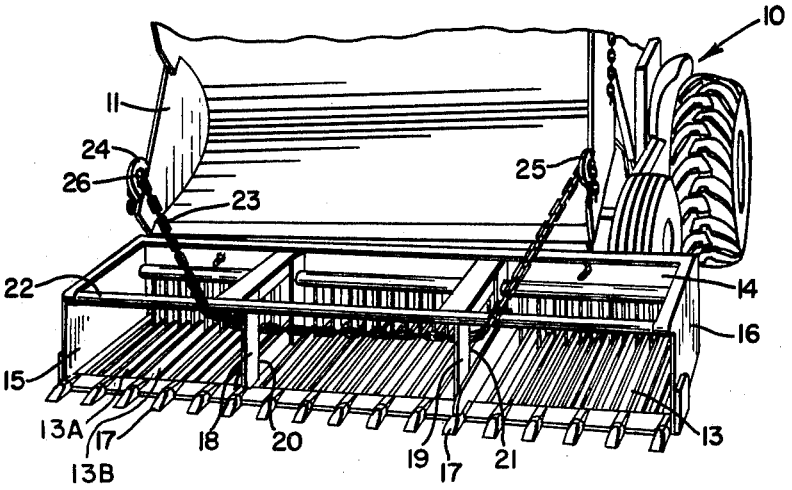
FIG. 1 is a front perspective view of the apparatus of the present invention attached to the bucket of a front end loader.
Figure 2:
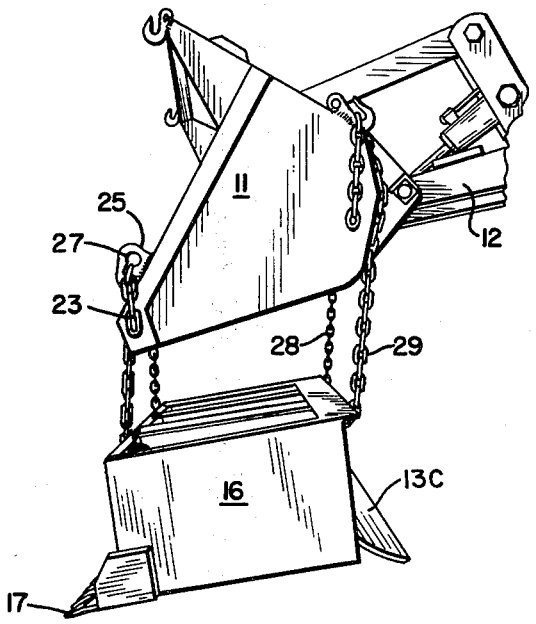
FIG. 2 is a side elevational view of the apparatus of FIG. 1.

Referring now to FIGS. 1 and 2, 10 designates a front end loader having a bucket 11 connected in the conventional manner to a dipstick or the like 12. The scraper-sifter device has a bottom trowel member 13 having an upstanding rear wall 14 and end walls 15, 16 defining an open front box-like structure having front scraper blades 17 on the leading edge of the trowel 13. The bottom of the trowel member 13 has a screen section formed by spaced bars 13A defining slotted like openings 13B therebetween for the passage of fine dirt or sand. Between the end walls 15, 16 are transversely spaced dividers 18, 19 having front to rear openings 20, 21 and a front bar 22 joining said end walls and dividers.

A concavo-convex blade backing member 13C is secured to the rear of the travel member 13, as best seen in FIG. 2, and is of the type shown in my prior U.S. Pat. No. 3,596,764.

The front attaching chain 23 is connected at each end to attaching lugs 24, 25 secured to the front end bucket and being provided with keyhole slots 26, 27 to anchor the chain 23.

The chain 23 is first set in keyhole slot lug 24, then passed over bar 22 back beneath bar 22, through openings 20, 21 in dividers 18 and 19, forwardly up and over bar 22 and then to keyhole slot in attaching lug 25.

The rear of the scraper-sifter device is connected to the front end bucket by chains 28, 29.

Figure 3:
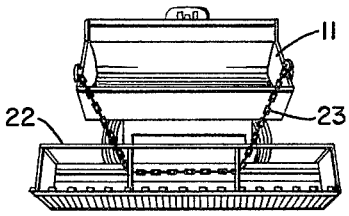
FIGS. 3 through 5 are front views of the apparatus of the present invention showing selective positioning of the sifter relative to the front end loader bucket due to variation of draft chain positioning.
Figure 4:
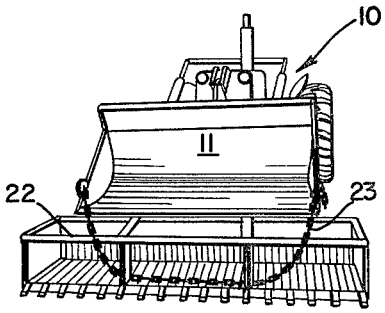
Figure 5:
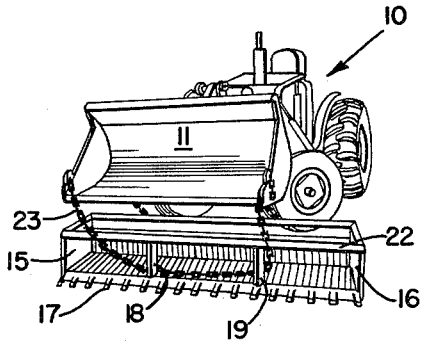

Referring to FIG. 3 the scraper-sifter apparatus is shown being lifted, as when full of debris to be loaded in a truck. As shown in FIG. 4 with the bucket 11 lowered the unit is now ready to be worked again to be moved through a mixture of dirt and rubble so that the dirt may be sifted out and the rubble collected for dumping in a truck. At this point the angle of attack of the device may be varied. With the front chain 23 slack, as shown in FIG. 4, the front end loader may be turned as shown in FIG. 5 which will permit the chain 23 to pass through openings 20, 21 and over the bar 22 until the desired angle between the bucket and scraper-sifter device is attained at which time the front end loader is driven forward and the device will pick up dirt and rubble at the desired angle of attack.

I claim:

1. For use with a front end loader having a loading bucket with key slot openings at the base of the front end of each of its sidewalls, a ground-leveling and separating device comprising, a substantially flat main blade having a slotted rear portion, a concavo-convex blade backing trowel member secured to the rear of the slotted portion of the main blade with the concavity thereof directed rearwardly of the main blade, end and rear walls upstanding from said blade, a pair of transversely spaced dividers having front to rear openings and a front bar joining said end walls and dividers, attaching means one end of which is adapted to be connected to the rear of the front end loader bucket and the other end connected to the rear of said device, and attaching means connected proximate the forward end of said front end loader bucket at each of its ends and adapted to be passed over said front bar and passing freely through the openings in said spaced dividers so that said ground-leveling and separating device could be selectively angularly oriented relative to said bucket and line of draft.

* * * * *